US008464888B2

(12) United States Patent
Hayashi

(10) Patent No.: US 8,464,888 B2
(45) Date of Patent: Jun. 18, 2013

(54) LID OF BEVERAGE CONTAINER

(75) Inventor: Kouji Hayashi, Hino (JP)

(73) Assignees: Kabushiki Kasiha Yakult Honsha, Tokyo (JP); Shikoku Kakoki Co., Ltd., Tokushima (JP)

( * ) Notice: Subject to any disclaimer, the term of this patent is extended or adjusted under 35 U.S.C. 154(b) by 119 days.

(21) Appl. No.: 13/059,217

(22) PCT Filed: Aug. 18, 2009

(86) PCT No.: PCT/JP2009/064422

§ 371 (c)(1),
(2), (4) Date: May 10, 2011

(87) PCT Pub. No.: WO2010/024148

PCT Pub. Date: Mar. 4, 2010

(65) Prior Publication Data

US 2011/0204057 A1 Aug. 25, 2011

(30) Foreign Application Priority Data

Aug. 29, 2008 (JP) ..... 2008-221340

(51) Int. Cl.
*B65D 17/42* (2006.01)

(52) U.S. Cl.
USPC ..... 220/277; 220/708; 215/229; 215/388

(58) Field of Classification Search
USPC ..... 220/260, 265, 277, 278, 705, 703, 220/709; 215/228, 229, 388; 206/217
See application file for complete search history.

(56) References Cited

U.S. PATENT DOCUMENTS

| | | | | |
|---|---|---|---|---|
| 3,524,566 | A | 8/1970 | Parks | |
| 3,945,528 | A * | 3/1976 | Mowrey, Jr. | 220/265 |
| 4,948,009 | A * | 8/1990 | Sawatani | 220/229 |
| 5,147,065 | A | 9/1992 | Rush et al. | |
| 5,397,023 | A * | 3/1995 | Toczek et al. | 220/709 |

(Continued)

FOREIGN PATENT DOCUMENTS

| | | | |
|---|---|---|---|
| DE | 10057277 | A1 | 5/2002 |
| EP | 1486149 | A1 | 12/2004 |

(Continued)

OTHER PUBLICATIONS

International Search Report for PCT/JP2009/064422, Nov. 17, 2009.

*Primary Examiner* — Mickey Yu
*Assistant Examiner* — Kareen Rush
(74) *Attorney, Agent, or Firm* — Smith Patent Office

(57) ABSTRACT

Provided is the lid of a beverage container consisting of synthetic resin similarly to the container and constituted in such a manner that a straw can easily run through the lid, and the content, i.e. the beverage, does not leak even if shock is applied. The lid of a beverage container consists entirely of synthetic resin (R), wherein a substantially circular straw sticking region (20) is provided in a part (e.g. the center) of the lid, a plurality of cuts (Hc) having a depth equal to ¼-½ of the thickness of the synthetic resin material are formed in the straw sticking region (20), and the straw sticking region (20) has a diameter of 8.0 mm or less and the cut (Hc) has a length of 3.0 mm or less.

6 Claims, 6 Drawing Sheets

U.S. PATENT DOCUMENTS

| | | | | |
|---|---|---|---|---|
| 5,425,471 | A * | 6/1995 | Wendt | 220/705 |
| 6,158,155 | A * | 12/2000 | Boney | 40/307 |
| 6,783,019 | B2 * | 8/2004 | Zettle et al. | 220/254.3 |
| 7,178,685 | B2 * | 2/2007 | Hidalgo et al. | 220/229 |
| 7,845,513 | B2 * | 12/2010 | White | 220/705 |
| 8,196,772 | B2 * | 6/2012 | Leon et al. | 220/669 |
| 2004/0140314 | A1 * | 7/2004 | Li | 220/709 |

FOREIGN PATENT DOCUMENTS

| | | | |
|---|---|---|---|
| JP | 48-49075 | U | 6/1973 |
| JP | 07-061469 | A | 3/1995 |
| JP | 2005-075443 | A | 3/2005 |
| JP | 2005-343508 | A | 12/2005 |
| JP | 2006-240667 | A | 9/2006 |

* cited by examiner

LID OF BEVERAGE CONTAINER

TECHNICAL FIELD

The present invention relates to a lid for sealing an opening of a container filled with a food or beverage in fluid form. In further detail, the present invention relates to a structure of a resin lid capable of being easily punctured by a straw, or the like.

PRIOR ART

Beverages or food and beverage in fluid form can be drank (ingested) by being poured from an opening in a container into another container; drinking directly from an opening in the container; or further, drinking through a straw, etc., which punctures and pierces the lid sealing the container.

In prior arts, beverages or food and beverage in fluid form have often been contained in, for instance, a plastic container having an aluminum cap (laminate of aluminum foil and a resin) as a lid. Therefore, the lid could be easily punctured by a straw such that the contents (food and/or beverage in fluid form) could be sucked through a straw.

However, today people are obligated to sort and discard trash as a way of protecting the environment. The days, on which a municipality collects the trash, are different dependent upon a type of trash.

Synthetic resins such as plastics and noncombustible trash such as aluminum caps must be separated and discarded, and people who drink food and beverages in fluid form must separately discard the container (such as a plastic container) and the lid (such as a laminated lid made from aluminum foil and a resin). Moreover, the container and lid must be transported to and collected at different collection locations on the respective days.

Thus, separately discarding the container and the lid as different types of trash imposes a heavy load on the user.

In order to solve the above-mentioned inconveniences, there have been attempts to manufacture both of a container and a lid from a synthetic resin (such as a plastic) such that they can be discarded as the same type of trash without being separated.

According to the experiments of the inventors, when an aluminum cap is punctured by a plastic straw, the straw can pierce the cap under a force of 8.83 N. In contrast to this, a force of 27.20 N is required for a plastic straw to puncture a synthetic resin lid.

That is, there is a problem in a case that the lid is made from a synthetic resin, in comparison with a case of an aluminum cap, it is difficult for a plastic straw attached to the container to puncture and pierce the lid in order to drink the contents (food and/or beverage in fluid form).

Other prior art is proposed in which a container lid is formed from a synthetic resin, but a thickness of the synthetic resin at a part to be punctured by the straw is thinner so that the container lid is easily punctured by the straw (Patent Document 1).

Here, a required property of the container lid is be capable of withstanding damage caused by minor impact. Because a container might be exposed to impact when large amounts of containers having lids are transported during the course of distribution. Also, because a user might drop a container filled with contents before the lid has been removed.

However, in the above-mentioned prior art (Patent Document 1), since the synthetic resin is thinner at the part to be punctured by a straw, in a case that an external force is applied, the part where the thickness of resin is thinner will be damaged and the contents will leak.

Also, another prior art have been proposed, in which a lid of a plastic container is made from a plastic material and the lid is perforated and punctured easily by a straw.

However, the above-mentioned another prior art does not intend to take impact resistance of the perforated part, and also, in a case that impact is applied, a resulting stress will be focused at the perforated part, or at the ends of the perforated part, tears will spread, and contents will leak from the tears.

Patent Document 1: Published unexamined Japanese utility model application Gazette S48-49075

Patent Document 2: Published unexamined Japanese Patent application Gazette H7-61469

DISCLOSURE OF INVENTION

Problems to be solved by Invention

The present invention was proposed in consideration of the above-mentioned problems in the prior art, and an object thereof is to provide a lid for a beverage container, in which both the container and the lid are formed from a synthetic resin, a straw is capable of easily puncturing the synthetic resin lid, and beverage contents will not leak even under impact.

Means for Solving Problems

The inventors focused on the fact that when "half-cutting," which is a type of laser working, is performed on a lid (10) made of a resin (R), strength of a worked part (straw puncture region/straw hole: 20) is reduced and a straw (14) can puncture and easily pierce the lid (10).

In addition, the inventors discovered that spreading of a tear in the lid (10) can be effectively prevented by maintaining a straw puncture region (straw hole 20) at a predetermined characteristic dimension (such as the diameter in the case of a round straw hole 20) or smaller, and maintaining a half-cut (half-cut part) at a predetermined length or shorter.

The present invention is proposed based on the above-mentioned knowledge.

The lid for a beverage container of the present invention is characterized in that:

an entirety of the lid is formed from a synthetic resin (R);

a straw puncture region (straw hole 20) is substantially round and is disposed in a portion of the lid (for instance, a center);

multiple perforated parts (half-cuts Hc) are formed in the straw puncture region (20) to a depth that corresponds to ¼ to ½ (preferably approximately ⅓) a thickness of the synthetic resin;

a diameter (R1×2) of the straw puncture region (20) is 8.0 mm or less (preferably 7.0 mm or less); and a length of the perforated parts (Hc) is 3.0 mm or less (preferably 2.5 mm or less) (claim 1).

Preferably, in the present invention, circular arch perforated parts, first linear perforated parts, second linear perforated parts and third linear perforated parts are formed in the straw puncture region (20):

the circular arch perforated parts (half-cut parts C1, C2, and C3) define an imaginary circle in an outermost shell of the straw puncture region (20);

the first linear perforated parts (half-cut parts TL1, TL2, and TL3) are, formed in a region on an inside of an imaginary circle which is defined by the circular arch perforated parts (half-cut parts C1, C2, and C3), and define an imaginary equilateral triangle such that apexes are positioned outside of the imaginary circle (imaginary circle defined by half-cut parts C1, C2, and C3) and a center of gravity coincides with a center of an imaginary circle (center of uncut part BCC);

the second linear perforated parts (half-cut parts TLC1, TLC2, and TLC3) extend from the center of the imaginary circle (center of the uncut part BCC) in a radial and outside direction of the imaginary circle; and the third linear perforated parts (half-cut parts TLM1, TLM2, and TLM3) extend parallel to the first linear perforated parts (half-cut parts TL1, TL2, and TL3) in a region between the first linear perforated parts (half-cut parts TL1, TL2, and TL3) and the second linear perforated parts (half-cut parts TLC1, TLC2, and TLC3) (claim 2).

Moreover, in the present invention, preferably a perforated part (half-cut Hc) is not formed in regions (UHc1, UHc2, UHc3) at which the second linear perforated parts (half-cut parts TLC1, TLC2, and TLC3) extend to the radial and outside direction (claim 3).

Furthermore, in the present invention, preferably the circular arch perforated parts (half-cut parts C1 through C3) and first linear perforated parts (half-cut parts TL1 through TL3) are separated by regions in which perforated parts are not formed (uncut parts C1B, C2B, C3B, TL1B, TL2B, and TL3B) (claim 4).

Effect of Invention

By means of the present invention having the above-mentioned constitutions, the straw puncture region (20) has multiple perforations (half-cuts Hc) to a depth which is ¼ to ½ (preferably approximately ⅓) of the thickness of the synthetic resin; and therefore, though the lid (10) made of the synthetic resin (R), the lid (10) can be easily punctured by the straw (14) at the straw puncture region (20).

Here, in the present invention, the depth of the perforated part (half-cut Hc) is ¼ to ½ (preferably approximately ⅓ ) of a thickness of the synthetic resin material; a diameter (R1×2) of the straw puncture region (20) is 8.0 mm or less (preferably 7.0 mm or less); and a length of the perforated part (half-cut Hc) is 3.0 mm or less (preferably 2.5 mm or less). Therefore, when impact is applied to a beverage container (12) or when the beverage container is punctured by the straw (14), tearing of the lid (10) or the straw puncture region (20) and spreading of tears from the perforated part (half-cut Hc) are prevented. And therefore, it is possible to prevent leakage of beverage contents when the beverage container (12) is exposed to impact and leakage of beverage from a puncture made by the straw (14) when the lid is punctured by a straw (14).

That is, the present invention provides a lid (10) made of a synthetic resin (R) capable of being easily punctured by a straw (14) without leakage of contents, even when exposed to impact.

In the present invention, by disposing circular arch perforated parts (half-cut parts C1, C2, and C3) that define an imaginary circle in an outermost shell of the straw puncture region (20) (claim 2), it is possible to define the outermost shell of the straw puncture region (20), which is a region being punctured by the straw (14) under a same force, and easily and reliably determine visually a center of the imaginary circle, which is a target for straw puncture.

Moreover, by disposing second linear perforated parts (half-cut parts TLC1 through TLC3) which extend from the center of the imaginary circle (center of uncut part BCC) in the radial and outside direction of the imaginary circle (claim 2), a force pressing on a straw end (14E), which has a crescent-shaped cross section, when the lid (10) is punctured by the straw end (14E) having a crescent-shaped cross section, can be reliably applied to second linear perforated parts (TLC1 through TLC3) a thickness of which are thinner (by approximately ¼ to ½). Therefore, a stress of a puncture pressure from the straw (14) is focused and the second linear perforated parts (TLC1 through TLC3) are easily and reliably break.

Furthermore, in the present invention, by forming first linear perforated parts (half-cut parts TL1, TL2, and TL3), which define an imaginary equilateral triangle such that apexes are positioned outside of the imaginary circle (imaginary circle defined by half-cut parts C1, C2, and C3) and a center of gravity coincides with a center of the imaginary circle (center of uncut part BCC), and third linear perforated parts (half-cut parts TLM1, TLM2, and TLM3) that extend parallel to the first linear perforated parts (half-cut parts TL1, TL2, and TL3) in a region between the first linear perforated parts (half-cut parts TL1, TL2, and TL3) and second linear perforated parts (half-cut parts TLC1, TLC2, and TLC3) (claim 2), a surface area of a part in which perforated parts (half-cuts Hc) are not formed in the straw puncture region (20) is small, and it guarantees that the straw (14) can puncture the lid (10) under a uniform and relatively small force.

In addition, when a perforated part (half-cut Hc) is not formed in regions (UHc1, UHc2, UHc3) at which the second linear perforated parts (half-cut parts TLC1, TLC2, and TLC3) extend toward the outside radially (claim 3), the regions at which there is outside extension radially (UHc1, UHc2, UHc3) remain in lid (10) and a region (DP) enclosed by perforated parts (half-cuts Hc) will not separate and fall from the lid (10), even if the synthetic resin tears at the perforated parts (half-cuts Hc) and the area enclosed by perforated parts (half-cuts Hc) hangs down when the region for straw puncture (20) is punctured by a straw (14). Therefore, it is possible to prevent the region (DP) enclosed by perforated parts (half-cuts Hc) from mixing in the beverage (refer to FIG. 9).

In addition, in the present invention, in a case that the circular arch perforated parts (half-cut parts C1 through C3) and the first linear perforated parts (half-cut parts TL1 through TL3) are separated by regions (uncut parts C1B, C2B, C3B, TL1B, TL2B, and TL3B) in which perforated parts are not formed (claim 4), it is possible to satisfy the condition of the length of the perforated part (half-cuts Hc) being 3.0 mm or less (preferably 2.5 mm or less).

Figure 1:
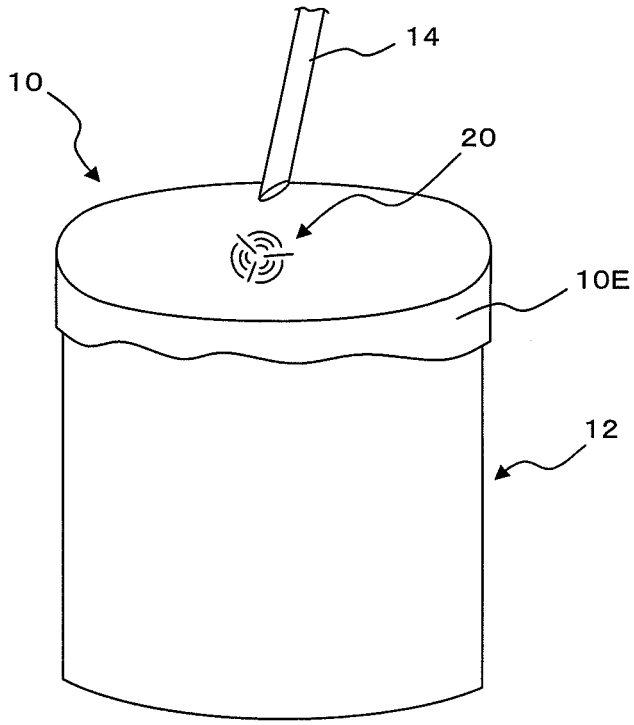
FIG. 1 is a perspective view illustrating a summary of the embodiment of the present invention.

| Reference Numerals | |
|---|---|
| 1 | Filling machine |
| 2 | Sealing machine |
| 3 | Caulking mechanism |
| 4 | Laser cutter |
| 10 | Lid |
| 12 | Beverage container |
| 14 | Straw |
| 14E1, 14E2, 14E3, 14EC | Cross section of straw end |
| 20 | Straw puncture region/straw hole |
| Hc | Perforated part/half-cut |
| R | Synthetic resin |
| C1, C2, C3 | Circular arch half-cut part defining circle of an outermost shell of straw hole |
| TL1, TL2, TL3 | Linear half-cut part defining equilateral triangle in straw hole |
| TLC1, TLC2, TLC3 | Linear half-cut part extending from center of straw hole to the outside radially |
| TLM1, TLM2, TLM3 | Linear half-cut part formed in straw hole |
| C1B, C2B, C3B, TL1B < TL2B, TL3B, UHc1, UHc2, UHc3 | Region in which half-cut parts are not formed/uncut part |
| BCC | Center of straw hole |
| a, b, c, d | Straw puncture position |

PREFERRED EMBODIMENT OF THE INVENTION

An embodiment of the present invention will now be described while referring to the drawings.

In FIG. 1, an entirety of the lid according to the embodiment of the present invention is represented by 10, and covers an opening in the beverage container 12 (top end of container 12 in FIG. 1). It should be noted that an entirety of the lid 10 is formed from a synthetic resin alone and the lid 10 does not contain aluminum foil as a base. Examples are a base selected from one or a combination of two or more synthetic resins such as PS (polystyrene) resin, AS (styrene-acrylonitrile copolymer) resin, ABS (acrylonitrile-butadiene-styrene copolymer) resin, or AXS resin (terpolymer having an acrylonitrile and a styrene component) (refer to JPA 2004-74796, JPA 2004-76009, and JPA 2004-76010).

FIG. 1 illustrates a state where a straw 14 punctures the lid 10, and an end of the straw 14 moves toward a straw puncture region (straw hole) 20 disposed at a center of the lid 10.

Figure 2:
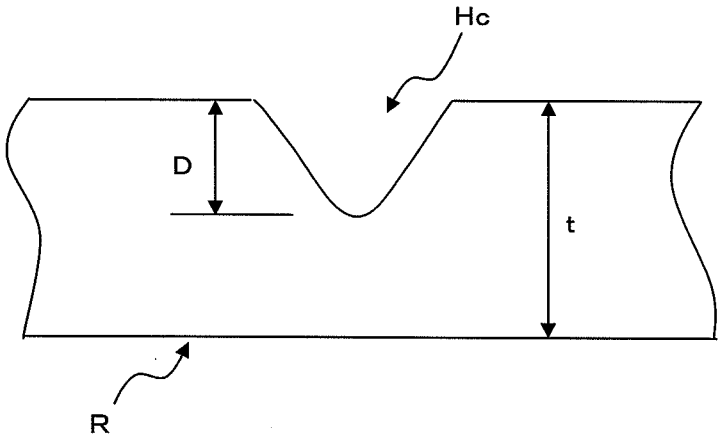
FIG. 2 is a partial enlargement illustrating perforated parts formed in a lid according to the embodiment.

As described below, the straw hole 20 is formed by forming multiple perforated parts, specifically, half-cuts Hc, in the synthetic resin that forms the lid 10. FIG. 2 illustrates a state where half-cuts Hc have been made in the synthetic resin R that forms the lid 10.

As is clear from FIG. 2, the half-cut Hc is formed as a perforation having a triangular cross section that cuts the synthetic resin R to a depth D of approximately ¼ to approximately ½, preferably approximately ⅓, the dimension in the direction of thickness. Moreover, with the illustrated embodiment, the depth D of the half-cut HC, in the synthetic resin R having a thickness of 195 μm, is approximately 60 μm (approximately ⅓ the thickness of the material of the lid 10).

Figure 3:
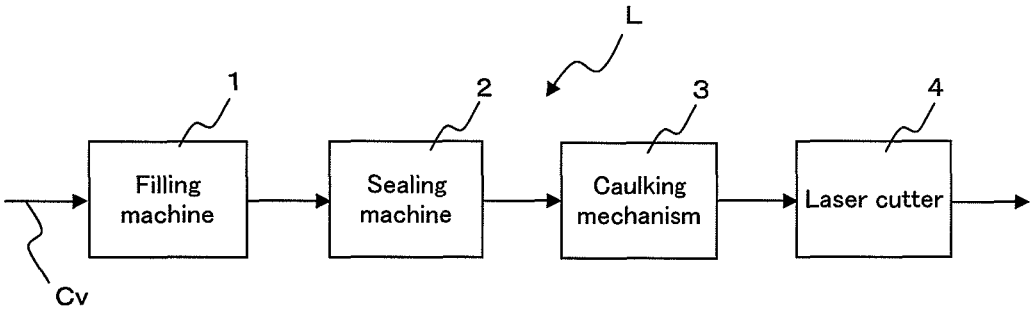
FIG. 3 is an explanatory diagram illustrating a line for producing a container sealed by the lid according to the embodiment.

FIG. 3 illustrates a summary of a system for forming the straw hole 20 by forming the half-cut Hc in the lid 10 of the beverage container 12.

In FIG. 3, a line for producing products wherein predetermined contents are filled and appropriately sealed inside a beverage container is shown by a L, and there is a conveyor (such as a belt conveyor) Cv for conveying the beverage container 12).

A filling machine 1, sealing machine 2, caulking mechanism 3, and laser cutter 4 are disposed at conveyor Cv.

At filling machine 1, a predetermined amount of beverage is filled inside an empty beverage container 12. Moreover, the opening of the container 12 filled with the beverage is sealed with the synthetic resin lid by the sealing machine 2.

At the step for sealing by sealing machine 2, the synthetic resin lid simply covers the opening of the container 12. However, the caulking mechanism 3 folds an edge 10E of the lid (refer to FIG. 1) along a top edge (edge on open side) of sides of the container 12 in order to enclose an opening in the container 12 as shown in FIG. 1.

The filling machine 1, sealing machine 2, and caulking mechanism 3 can be conventional devices.

The beverage container is conveyed to the laser cutter 4 once the caulking mechanism 3 has covered the container such that the lid 10 encloses the opening in the container 12.

The laser cutter can be a conventional commercial laser cutter (such as the ML-Z95001® commercial 3-dimensionally controlled $CO_2$ laser marker made by Keyence Corporation).

Laser cutter 4 forms half-cuts Hc in the surface of the synthetic resin lid 10 that covers the container such that the opening in the beverage container 12 is enclosed.

Figure 4:
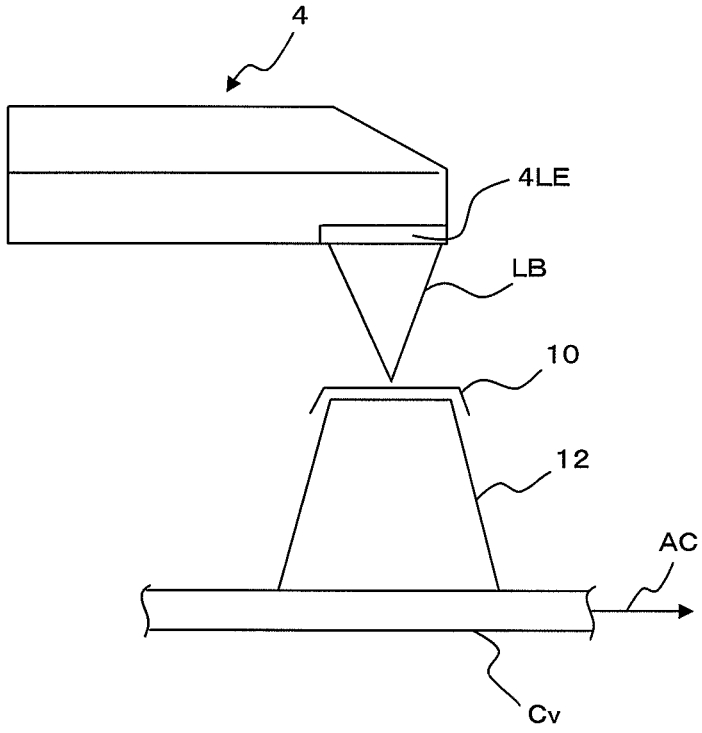
FIG. 4 is an explanatory diagram summarizing a device for forming the perforations in FIG. 2 in a lid.

FIG. 4 illustrates the state where half-cuts Hc are formed in the lid 10 that covers the opening of the beverage container 12.

In FIG. 4, the lid 10 covering the opening of the beverage container 12 riding on the conveyor Cv is exposed to laser light beams (such as $CO_2$ laser light beams) from a laser irradiation part 4LE of the laser cutter 4.

In FIG. 4, the conveyor Cv moves continuously in a direction shown by arrow AC, and moves continuously while the half-cuts Hc are being formed in the lid 10. In other words, the conveyor Cv moves continuously in the direction of arrow AC and does not stop when the half-cuts Hc are being formed. Moreover, the laser cutter 4 has a function for forming half-cuts Hc exactly to a specified shape in an object moving at a relatively high speed (such as the lid 10 of the beverage container 12 on the conveyor Cv).

Figure 5:
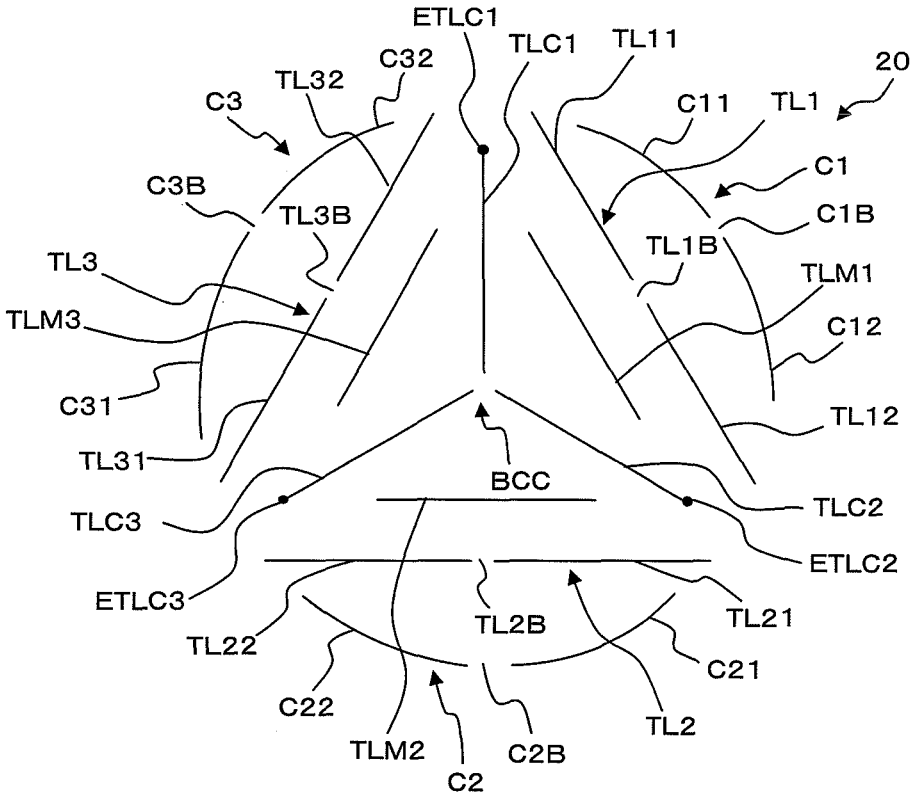
FIG. 5 is an enlargement illustrating details of the perforated parts formed in a lid.

FIG. 5 illustrates the straw hole 20 obtained when the half-cuts Hc were formed by laser cutter 4 in the illustrated embodiment.

Here, the curved lines and straight lines that form the half-cuts Hc of the straw hole 20 of the lid 10 are represented as "half-cut parts". Moreover, parts where the half-cuts Hc are not formed are represented as "uncut parts."

The straw hole 20 has curved half-cut parts C1, C2, and C3 (arc-shaped perforated parts) in three places disposed such that an arc is formed at an outside edge. The curved half-cut parts C1, C2, and C3 in three places are formed so as to define an imaginary circle of an outermost shell of the straw hole 20.

Curved or circular arc-shaped half-cut part C1 separates into curved or circular arc-shaped parts C11 and C12 at a part C1B that has not been half-cut (uncut part). Similarly, circular arc-shaped half-cut part C2 separates into circular arc-shaped part C21 and C22 at uncut part C2B, and circular arc-shaped half-cut part C3 separates into circular arc-shaped parts C31 and C32 at uncut part C3B.

In the straw hole 20, linear half-cut parts TL1, TL2, and TL3 (first linear perforated parts) are formed such as to form three sides of an equilateral triangle on an inside of a circle (imaginary circle) formed by circular arc-shaped half-cut parts C1 through C3.

In other words, the linear half-cut parts TL1, TL2, and TL3 are disposed so as to form a shape wherein three apexes of an equilateral triangle are omitted. Moreover, the linear half-cut parts TL1, TL2, and TL3 define an equilateral triangle (imaginary equilateral triangle) wherein apexes are positioned outside the imaginary circle as defined by circular arc-shaped half-cut parts C1, C2, and C3.

Here, the center of gravity of the imaginary equilateral triangle defined by linear half-cut parts TL1, TL2, and TL3 coincides with the center of the imaginary circle defined by circular arc-shaped half-cut parts C1, C2, and C3. Moreover, the center of gravity of the imaginary equilateral triangle or the center of the above-mentioned imaginary circle is also the center of uncut part BBC.

In order to simplify the drawing in FIG. 5, reference numerals are not provided for a center of gravity of the imaginary equilateral triangle, a center of the imaginary circle, and a center of uncut part BBC. However, uncut part BBC is a small region and therefore, the center of gravity of the imaginary equilateral triangle or the center of the imaginary circle is sometimes represented as BCC for simplification in the present specification.

Linear half-cut part TL1 separates into linear parts TL11 and TL12 at uncut part TL1B.

Similarly, linear half-cut part TL2 separates into linear parts TL21 and TL22 at uncut part TL2, and linear half-cut part TL3 separates into linear parts TL31 and TL32 at uncut part TL3B.

Three linear half-cut parts TLC1, TLC2, and TLC3 (second linear perforated parts) are formed at the straw hole 20, from the center of the circle formed by circular arc-shaped half-cut parts C1 through C3 toward each apex of the equilateral triangle formed by linear half-cut parts TL1, TL2, and TL3, or extending toward the outside in a radial direction of the circle formed by circular arc-shaped half-cut parts C1 through C3.

Half-cut part TLC1 is disposed on a bisector (imaginary line) dividing an angle formed by half-cut parts TL1 and TL3 into two equal parts.

Half-cut part TLC2 is disposed on a bisector (imaginary line) dividing an angle formed by half-cut parts TL1 and TL2 into two equal parts.

Half-cut part TLC3 is disposed on a bisector (imaginary line) dividing an angle formed by half-cut parts TL2 and TL3 into two equal parts.

In FIG. 5 ETLC1 is an end on an apex side of an equilateral triangle of half-cut part TLC1 (side opposite the center of the circle formed by C1 through C3); ETLC2 is an end on an apex side of an equilateral triangle of half-cut part TLC2 (side opposite the center of the circle formed by C1 through C3); and ETLC3 is an end on an apex side of an equilateral triangle of half-cut part TLC3 (side opposite the center of the circle formed by C1 through C3).

As previously described, the center of the circle formed by circular arc-shaped half-cut parts C1 through C3 coincides with the center of gravity of the equilateral triangle formed by linear half-cut parts TL1, TL2, and TL3.

Moreover, the three linear half-cut parts TLC1, TLC2, and TLC3 are separated by uncut part BCC at the center of the circle formed by circular arc-shaped half-cut parts C1 through C3 (or the center of gravity of the equilateral triangle formed by half-cut parts TL1, TL2, and TL3).

In other words, the center of the circle formed by the circular arc-shaped half-cut parts C1 through C3, or the center of gravity of the equilateral triangle formed by linear half-cut parts TL1 through TL3, becomes the uncut part BCC.

Three linear half-cut parts TLM1, TLM2, and TLM3 (third linear perforated parts) are formed in the straw hole 20 shown in FIG. 5, in a region between the three linear half-cut parts TL1 through TL3 that form the equilateral triangle and the three linear half-cut parts TLC1 through TLC2 that extend so as to connect the center of the circle formed by circular arc-shaped half-cut parts C1 through C3 (or the center of gravity of the equilateral triangle formed by half-cut parts TL1, TL2, and TL3) and each apex of the equilateral triangle.

In further detail, the linear half-cut part TLM1 is formed parallel to the half-cut part TL1 in an isosceles triangle formed by linear half-cut parts TL1, TLC1, and TLC2.

Linear half-cut part TLM2 is formed parallel to half-cut part TL2 in an isosceles triangle formed by linear half-cut parts TL2, TLC2, and TLC3.

Linear half-cut part TLM3 is formed parallel to half-cut part TL3 in an isosceles triangle formed by linear half-cut part TL3, TLC3, and TLC1.

The above-mentioned circular arc-shaped half-cut parts C1, C2, and C3 (half-cut parts that form a circle), linear half-cut parts TL1, TL2, and TL3 (half-cut parts that form an equilateral triangle), three linear half-cut parts TLC1, TLC2, and TLC3 (half-cut parts that extend from the center of the circle toward the outside radially), and three linear half-cut parts TLM1, TLM2, and TLM3 (half-cut parts that are formed in the region between TL1 through TL3 and TLC1 through TLC3) each are formed at the center of the lid 10 independently without being connected to another half-cut part.

Next, an example of the layout and dimensions of the straw hole 20 in FIG. 5 will be described while referring to FIG. 6.

Figure 6:
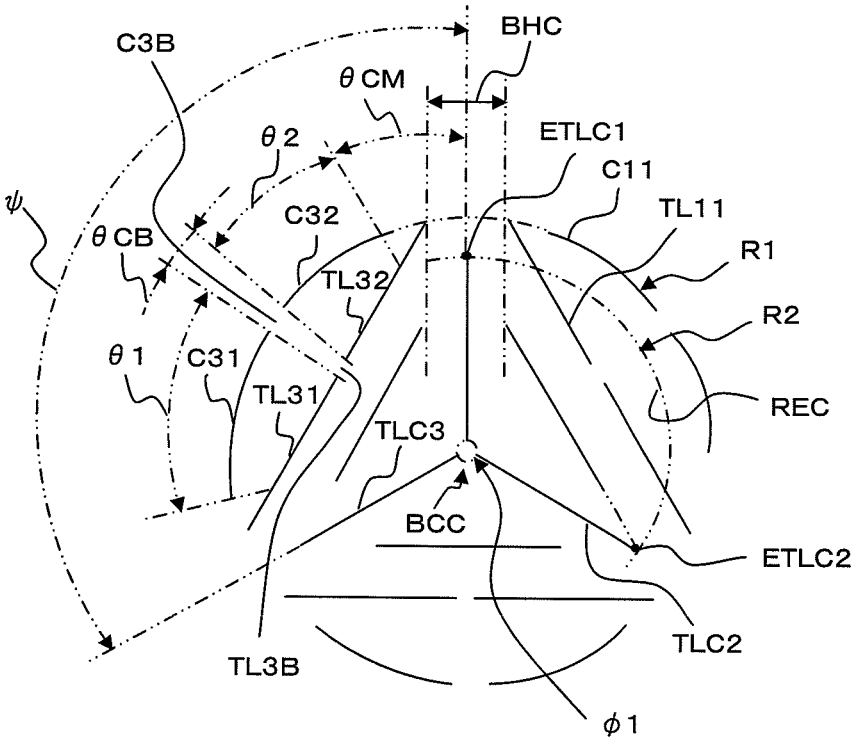
FIG. 6 is an enlargement describing dimensions and positions of the perforated parts shown in FIG. 5.

In FIG. 6, a curvature radius of circular arc-shaped part C11 is represented by R1, and the curvature radius R1 is set at 3 mm for instance. Here, the curvature radius R1 is the curvature radius of the circle formed by the circular arc-shaped half-cut parts C1, C2, and C3, and is shared by circular arc-shaped half cut parts the C1, C2, and C3 and the components C11, C12, C21, C22, C31, and C32 thereof.

R2 is a curvature radius of imaginary circle RE, which is obtained by joining ends ETLC1, ETLC2, and ETLC3 at the apexes of the equilateral triangle at each of linear half-cut parts TLC1 through TLC3, and is 2.5 mm for instance. The entire imaginary circle RE is not shown in FIG. 6, and only an imaginary circular arc where the end ETLC1 of the half-cut part TLC1 and the end ETLC2 of the half-cut part TLC2 are joined is shown.

As described above, the center of the circle formed by the circular arc-shaped half-cut parts C1 through C3, or the center of gravity of the equilateral triangle formed by the linear half-cut parts TLC1 through TLC3, serves as the uncut part BCC. A diameter of this uncut part BCC is represented by $\phi 1$, and is 0.1 mm for instance. In other words, $\phi 1$ (=0.1 mm) is the diameter of an imaginary circle obtained by joining the ends at the center of the circle (center of gravity of the equilateral triangle) at the three half-cut parts TLC1 through TLC3.

The angle (central angle) formed by linear half-cut parts TLC3 and TLC1 is represented by $\psi$ and is set at 120°. The central angle $\psi$ is the same as the angle formed by half-cut parts TLC1 and TLC2 and the angle formed by half-cut parts TLC2 and TLC3.

The term "central angle" here means an angle that is formed with respect to the center of the circle formed by circular arc-shaped half-cut parts C1 through C3 (corresponds to the center of gravity of the equilateral triangle formed by linear half-cut parts TLC1 through TLC3).

Central angle $\theta 1$ of component C31 and central angle $\theta 2$ of component C32 of circular arc-shaped half-cut part C3 are a same angle, and are 37.5° for instance. Central angle $\theta$CB of uncut part C3B that separates into parts C31 and C32 is 5° for instance. Here central angle θCB is also a central angle of the uncut part TL3B that separates into parts TL31 and TL32 at linear half-cut part TL3.

Central angle θCB (=5°) shown in FIG. 6 is the same as a central angle at uncut part C1B that separates into parts C11 and C12, uncut part C2B that separates into parts C21 and C22, uncut part TL1B that separates into parts TL11 and TL12, and uncut part TL2B that separates into parts TL21 and TL22.

It should be noted that central angle θCB (=5°) shown in FIG. 6 is set such that uncut parts TL1B through TL3B are at least 0.2 mm or longer.

In FIG. 6, central angle θCM formed by a right end of component C32 and an extension of linear half-cut part TLC1 is 20° for instance. Moreover, the extension of linear half-cut part TLC1 becomes a center line of the right end of component C32 and a left end of component C11; therefore, a central angle of an uncut part present between arc-shaped half-cut parts C3 and C1 is twice θCM (=2×θCM=40). Moreover, central angle 2θCM (=40°) of the uncut part between arc-shaped half-cut parts C3 and C1 is the same as a central angle of an uncut part between half-cuts C1 and C2 and a central angle of an uncut part between half-cuts C2 and C3.

Length of the straight line joining the right end of component TL32 of linear half-cut part TL3 and the left end of component TL11 of linear half-cut part TL1 (length of the crescent), BHC, is set at 1 mm for instance.

The effects of forming each of the half-cut parts and uncut parts that form the straw hole 20 in FIGS. 5 and 6, as well as the reasons for setting the dimensions thereof, will be explained while referring to FIGS. 5 through 7.

Arc-shaped half-cut parts C1 through C3 in FIG. 5 are disposed within a consistent range from center BCC of the straw hole 20 in order to define a perimeter that serves as the outermost shell of the circular region formed by this consistent range so that the straw 14 is capable of puncturing and piercing the lid 10 under the same force.

When the half-cut parts Hc that define the outermost shell of the straw hole 20 form a triangle, the range of this triangle is not "a consistent range from center BCC of the straw hole 20." Therefore, it is difficult to visually recognize a region where "the straw 14 is capable of puncturing and piercing the lid 10 under the same force."

In other words, it is easier to visualize the center of a circle than the center of gravity of a triangle, and half-cut parts C1, C2, and C3 that define the outermost shell of the straw hole 20 were formed as arcs having the same curvature center as center BCC of the straw hole 20 such that the straw 14 would be capable of puncturing reliably the places that should be punctured by the straw 14.

Furthermore, when arc-shaped half-cut parts C1 through C3 serve as the outermost shell part, the surface area of the straw hole 20 can be larger than the surface area of the straw hole when the outermost shell is triangular or rectangular.

In FIG. 5, linear half-cut parts TLC1, TLC2, and TLC3 that extend from center BCC of the straw hole 20 toward the outside radially are formed for easy puncture by the straw 14.

Figure 7:
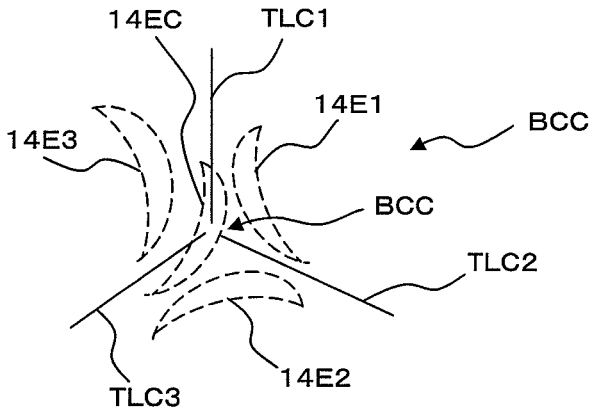
FIG. 7 is an enlargement describing a position relationship between the perforated parts shown in FIG. 5 and a straw end.

A cross section of the part of the straw 14 that punctures the lid 10 (cross section of the end of the straw 14) is crescent-shaped, as shown by 14E1, 14E2, 14E3, and 14EC in FIG. 7. As is clear from FIG. 7, the end of the straw 14 having a crescent-shaped cross section is disposed near two or three of linear half-cut parts TLC1, TLC2, and TLC3 that extend from the center of the straw hole 20 toward the outside radially. Consequently, the force that presses on the straw 14 is reliably applied to the half-cut parts TLC1 through TLC3 and as a result, the stress of this pressing force is focused on the half-cut parts HC that are thinner than (at approximately ¼ to ½ the thickness of) the uncut parts in the lid 10 and the half-cut parts TLC1 through TLC3 tear.

In particular, when the straw 14 punctures center BCC of the straw hole 20, the straw end 14E pierces linear half-cut parts TLC1 through TLC3 and therefore, the stress attributed to the force pressing the straw 14 is easily focused on the half-cut parts TLC1 through TLC3 and the lid 10 can be easily penetrated by the straw 14.

In FIG. 5, the three linear half-cut parts TL1 through TL3 formed in the straw hole 20 and the three linear half-cut parts TLM1 through TLM2 that are formed parallel to half-cut parts TL1 through TL3 are formed in the region between the arc-shaped half-cut parts C1 and C3 and the linear half-cut parts TLC1 through TLC3 that extend from center BCC toward the outside radially in order to guarantee that the surface area of the uncut part (of lid 10) will be small in this region and straw 14 will be able to puncture lid 10 under a uniform and relatively small force.

Specifically, half-cut parts TL1 through TL3 and linear half-cut parts TLM1 through TLM3 make it possible to increase a number of half-cut parts and thereby reduce the surface area of the straw hole 20 that is occupied by the uncut parts and to keep the force needed for the straw 14 to puncture the lid 10 at a relatively low level over the entire straw hole 20.

Moreover, it must be possible for the straw 14 to easily pierce the lid 10 in order to satisfy the condition of "maintaining a sealed state by the lid 10."

As was explained while referring to FIG. 2, in order to satisfy the condition of "maintaining a sealed state by the lid 10," the depth D of the half-cut He is approximately ¼ to approximately ½, preferably approximately ⅓) the thickness of the synthetic resin forming the lid 10. In the illustrated embodiment, the depth D of the half-cut Hc in the synthetic resin R having a thickness of 195 μm is set at approximately 60 μm (approximately ⅓ the thickness of the material of the lid 10) for instance.

Specifically, when the depth D of the half-cut Hc is deeper than approximately ½ the thickness of the synthetic resin forming the lid 10, there is a chance that the half-cut Hc will tear under some force prior to puncture by the straw 14 and the beverages contained inside the container 12 will leak.

On the other hand, when the depth D of the half-cut HC is shallower than approximately ¼ the thickness of the synthetic resin forming the lid, a large force will be needed for the straw 14 to puncture and pierce the straw hole 20 of the lid 10. Therefore, the depth D of the half-cut Hc is set at approximately ¼ to approximately ½, preferably approximately ⅓, the thickness of the synthetic resin that forms the lid 10.

In FIG. 5, linear half-cut parts TLC1, TLC2, and TLC3 that extend from center BCC of the straw hole 20 toward the outside radially are formed for easy puncture by the straw 14. The regions near any of outside ends ETLC1, ETLC2, and ETLC3 in the radial direction of linear half-cut parts TLC1 through TLC3 are formed such that when the straw 14 punctures the straw hole 20, the stress is focused and the half-cut part is torn to have the effect of an air hole.

By guaranteeing the related air hole, a path for the flow of air from outside the container 12 to inside the container 12 is guaranteed when the straw 14 punctures the lid and therefore, when the beverage is drank, it is possible to prevent noise from being generated when an air path is formed around the straw.

In FIGS. 5 and 6, the distance between the half-cut parts is at least 0.2 mm or greater. This is done such that when impact force is applied to the container 12 filled with a beverage, the half-cut parts will not tear and beverage filled inside the container 12 will not leak.

With regard to the beverage container 12, there are cases in which multiple beverage containers 12 are packaged in one pack and the packages are transported stacked on top of one another. There is a possibility that impact will be applied to the container 12 when the packaged are stacked during transport. Moreover, there is also a chance that impact will be applied to the container 12 when a user accidentally drops the beverage container 12 after it has been purchased.

The straw hole 20 must have a consistent impact resistance or greater such that the straw hole 20 does not easily tear and the beverage contained in the container does not leak when impact is applied to the container 12 in this way.

The distance (interval) between the half-cut parts Hc is set for at least 0.2 mm or greater in order to guarantee this impact resistance. Specifically, when the interval between the half-cut parts is less than 0.2 mm, there is a chance that the stress when impact is applied will be focused where the interval is less than 0.2 mm and the lid will tear from the half-cut part.

In addition, when the interval between the half cut parts is less than 0.2 mm, tears will spread from ends of those places where half-cut parts Hc have been made in the event that the straw hole 20 is punctured by the straw 14, or in the event that impact or another outside force is applied, and adjacent half-cut parts will link together. When the parts that have been half-cut link together to form a closed region, the material (the synthetic resin) of the lid 10 included in this closed region will separate from the rest of the lid 10 and fall into the beverage.

In order to prevent related accidents as well, the interval between the half-cut parts is set for at least 0.2 mm or greater.

Experiments conducted by the inventors clearly showed that there is a chance that when the straw hole 20 is inappropriately half-cut, crescent-shaped tears will form, not only in the straw hole 20 but over the entirety of the synthetic resin lid 10 (such that the lid 10 is cut horizontally), and the beverage contained in the container 12 will leak from the related crescent-shaped tears.

The inventors experimentally concluded that crescent-shaped tears will also form when the straw hole 20 has a large diameter (=curvature radius of circular arc-shaped half-cut parts C1 through C3).

Moreover, it is clear from the experiments conducted by the inventors that such tears will not form as long as the length of the individual half-cut parts formed in the straw hole 20 is 3.0 mm or shorter (preferably 2.5 mm or shorter), and the diameter of the straw hole 20 is 8.0 mm or less (preferably 7.0 mm or less).

The straw hole 20 is designed on the basis of the related experimental results. In other words, the curvature radius and central angle shown in FIG. 6 are designed so as to satisfy the conditions that "the length of the individual half-cut parts formed in the straw hole 20 is 2.0 mm or shorter (preferably 2.5 mm or shorter) and the diameter of the straw hole 20 is 8.0 mm or less (preferably 7.0 mm or less)."

It should be noted that the experiments of the inventors confirmed that the diameter of the straw hole 20 has a particularly strong effect on whether or not crescent-shaped tears will be generated to the extent that the lid 10 is torn horizontally.

On the other hand, the experiments conductor by the inventors also confirmed that the length of each half-cut part does have an effect in terms of generating tears, but not to the point that the entire lid 10 is torn horizontally.

In FIG. 5, linear half-cut parts TLC1, TLC2, and TLC3 that extend from center BCC of the straw hole 20 toward the outside radially do not reach the circle formed by the circular arc-shaped half-cut parts C1 through C3, and an area toward the outside radially in each of half-cut parts TLC1, TLC2, and TLC3 becomes an uncut part.

Figure 8:
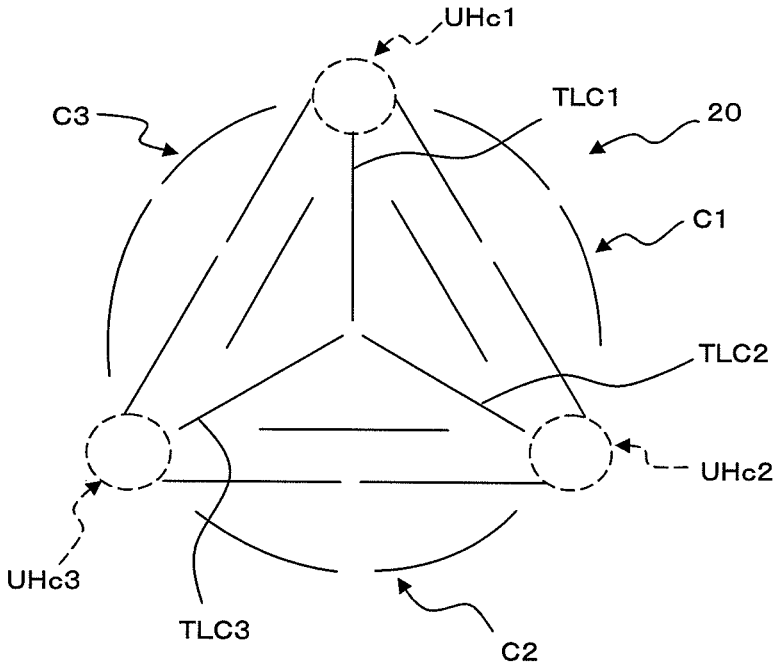
FIG. 8 is an enlargement describing parts where the perforated parts shown in FIG. 5 are not formed.

The related uncut parts are represented as regions UHc1, UHc2, and UHc3 shown by broken lines in FIG. 8.

Figure 9:
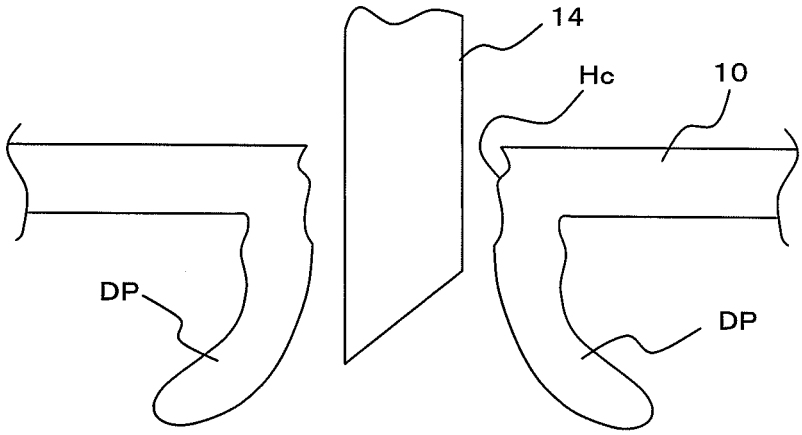
FIG. 9 is a partial enlarged cross section describing a state where the lid has been pierced by a straw.

As long as there are uncut parts UHc1, UHc2, and UHc3, the half-cut parts UHc1, UHc2, and UHc3 will remain and region DP will not separate from the lid 10 and will remain in the lid 10, even if the synthetic resin at half-cut parts Hc tears as a result of the straw hole 20 being punctured by the straw 14 and the region DP surrounded by the torn half-cut parts Hc hangs down as shown in FIG. 9. Therefore, thin pieces (or fragments) of the synthetic resin forming region DP will be prevented from mixing in the beverage product underneath the lid 10.

The inventors performed various studies of the lid 10 made of the synthetic resin according to the illustrated embodiment described while referring to FIGS. 1 through 9, including comparative experiments with conventional laminated lids formed from aluminum foil and resin (aluminum caps).

First, the lid 10 according to the illustrated embodiment was subjected to determination of the straw 14 puncture position and the puncture force required for piercing of the lid 10.

Figure 10:
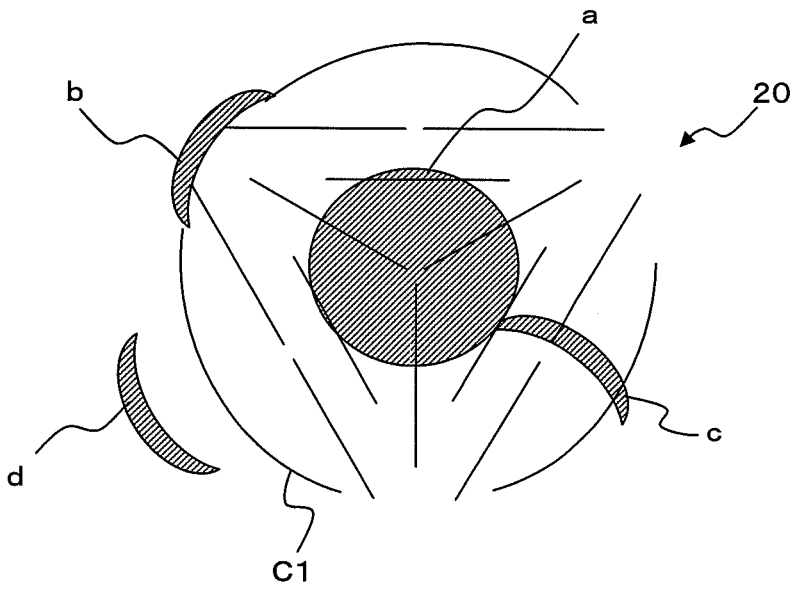
FIG. 10 is an enlargement showing the perforated parts illustrated in FIG. 5 and a position of straw puncture.

FIG. 10 shows the straw 14 puncture position in the experiment. The straw 14 puncture position in FIG. 10 is represented as positions a, b, c, and d marked by hatch marks.

Position a is a position near the center of the straw hole 20 and is represented as a circular graphic concentric with the center of the straw hole 20.

Position b is a position corresponding to uncut parts UHc1 through UHc3 in FIG. 8, and position c is outside position a, but is still a position inside the straw hole 20.

Position d is outside the straw hole 20. In further detail, position d is 1.5 mm away from circular arc-shaped half-cut part C that defines the outermost shell of the straw hole 20.

Table 1 shows the number of times the straw 14 punctured each position a through d (N number), the force needed for the straw 14 to pierce the lid 10 or the straw hole 20 (straw puncture force), and the number of times the end of the straw 14 bent out of the number of times the straw 14 punctured the lid (straw end bending). It should be noted that the straw puncture force was determined by using a tensile compression testing device (strograph) to measure the maximum stress until the straw pierced the lid when a straw having a diameter of 4 mm punctured the straw puncture region under a (uniform) speed of 100 mm/minute with the container anchored in place.

TABLE 1

| | Determination position | | | |
|---|---|---|---|---|
| | a | b | c | d |
| N number | 20 | 10 | 10 | 10 |
| Straw puncture force | 8.26N | 8.78N | 9.00N | 11.98N |
| Straw end bending | 0/20 | 0/10 | 0/10 | 0/10 |

The straw puncture force of a conventional aluminum cap as determined under the same experimental embodiment was generally uniform over the entire cap and was 8.83 N.

The "results of straw puncture" shown in Table 1 clarify the fact that when compared to the straw puncture force of 8.83 N of conventional aluminum caps, the lid 10 can be pierced by the straw 14 under the same straw puncture strength as a conventional aluminum cap as long as the straw punctured within straw hole 20 (within the circle as defined by circular arc-shaped half-cut parts C1 through C3) in the illustrated embodiment.

In particular, the straw 14 is capable of puncturing under a weaker force that with a conventional aluminum cap near the center of the straw hole 20 (position a in FIG. 10).

It should be noted that the force required for the straw 14 to puncture the lid 10 is greater than that with a conventional aluminum cap at position d, which is 1.5 mm away from the straw hole 20.

However, as is clear when referring to "straw end bending" at position d, in the illustrated embodiment, each attempt to make the straw 14 puncture the lid 10 was successful without any bending of the end of the straw, even when the straw 14 punctured a place 1.5 mm away from the straw hole 20 (position d).

Specifically, it was concluded that by means of the illustrated embodiment, the straw 14 is capable of penetrating the lid 10 with no bending at the tip, even when the straw 14 punctures a place where straw 14 puncture is difficult.

The inventors also performed experiments to determine whether or not, when the lid 10 according to the illustrated embodiment was pierced by the straw 14, the synthetic resin forming the lid 10 fell into the container 12.

The operation whereby the lid 10 was pierced by the straw 14 was repeated 50 times in the experiment without any fragments of the synthetic resin forming the lid 10 falling inside the container 12 (number of times fragments fell: 0/50).

The same experiment was conducted using a conventional aluminum cap, and the results were the same as with the illustrated embodiment.

By means of a separate experiment, a container 12 filled with a beverage was covered by a lid 10 according to the illustrated embodiment and dropped from an upright position at a height of 50 cm above the floor and checked for damage. The experiment was repeated 50 times, but there was no damage (number of times damaged: 0/50).

Therefore, it was clear that the lid 10 according to the illustrated embodiment had sufficient impact resistance.

The same experiment was conducted using a conventional aluminum cap, and the results were the same as with the illustrated embodiment.

The above-mentioned experiments ascertained that beverage contained in the container 12 will not leak, even when the lid 10 in the illustrated embodiment is exposed to impact, the force needed for the straw 14 to puncture the lid is the same as with a conventional cap, and the lid 10 material will not mix in the beverage when the straw 14 punctures the lid.

The illustrated embodiment is merely an example and is in no way intended to limit the technological scope of the present invention.

What is claimed is:

1. A lid of a beverage container comprising:

an entire lid formed from a synthetic resin;

a substantially round straw puncture region disposed in a portion of the lid;

multiple recessed areas formed in the straw puncture region to a depth that corresponds to ¼ to ½ of a thickness of the synthetic resin; and wherein a diameter of the straw puncture region is 8.0 mm or less; and a length of each of the recessed areas is 3.0 mm or less, wherein the multiple recessed areas include circular arch recessed areas, first linear recessed areas, second linear recessed areas and third linear recessed areas formed in the straw puncture region;

the circular arch recessed areas define an imaginary circle in an outermost shell of the straw puncture region;

the first linear recessed areas are formed in a region on an inside of an imaginary circle defined by the circular arch recessed areas, and define an imaginary equilateral triangle such that apexes are positioned outside of the imaginary circle and a center of gravity coincides with a center of the imaginary circle;

second linear recessed areas extend from the center of the imaginary circle in a radial and outside direction of the imaginary circle; and third linear recessed areas extend parallel to the first linear recessed areas in a region between the first linear recessed areas and the second linear recessed areas.

2. The lid for a beverage container according to claim 1, wherein a recessed area is not formed in regions where the second linear recessed areas extend to the radial and outside direction.

3. The lid for a beverage container according to claim 1, wherein the circular arch recessed areas and the first linear recessed areas are separated by regions where recessed areas are not formed.

4. The lid for a beverage container according to claim 2, wherein the circular arch recessed areas and the first linear recessed areas are separated by regions where recessed areas are not formed.

5. A lid of a beverage container comprising:

an entire lid formed from a synthetic resin;

a substantially round straw puncture region disposed in a portion of the lid;

multiple recessed areas formed in the straw puncture region to a depth that corresponds to ¼ to ½ of a thickness of the synthetic resin; and wherein a diameter of the straw puncture region is 8.0 mm or less; and a length of each of the recessed areas is 3.0 mm or less, wherein the multiple recessed areas include circular arch recessed areas, first linear recessed areas, second linear recessed areas and third linear recessed areas formed in the straw puncture region, and wherein the first linear recessed areas are formed in a region on an inside of an imaginary circle defined by circular arch recessed areas, and define an imaginary equilateral triangle such that apexes are positioned outside of an imaginary circle and a center of gravity coincides with a center of the imaginary circle.

6. A lid of a beverage container comprising:

an entire lid formed from a synthetic resin;

a substantially round straw puncture region disposed in a portion of the lid;

multiple recessed areas formed in the straw puncture region to a depth that corresponds to ¼ to ½ of a thickness of the synthetic resin; and wherein a diameter of the straw puncture region is 8.0 mm or less; and a length of each of the recessed areas is 3.0 mm or less, wherein the multiple recessed areas include circular arch recessed areas, first linear recessed areas, second linear recessed areas and third linear recessed areas formed in the straw puncture region, and wherein the third linear recessed areas extend parallel to the first linear recessed areas in a region between the first linear recessed areas and the second linear recessed areas.

* * * * *